US009988883B2

(12) United States Patent
Russell

(10) Patent No.: US 9,988,883 B2
(45) Date of Patent: Jun. 5, 2018

(54) WELLBORE SCREEN

(71) Applicant: ABSOLUTE COMPLETION TECHNOLOGIES LTD., Calgary (CA)

(72) Inventor: Thane Geoffrey Russell, Calgary (CA)

(73) Assignee: Absolute Completion Technologies Ltd., Calgary (CA)

( * ) Notice: Subject to any disclaimer, the term of this patent is extended or adjusted under 35 U.S.C. 154(b) by 547 days.

(21) Appl. No.: 14/410,479

(22) PCT Filed: Jul. 4, 2013

(86) PCT No.: PCT/CA2013/050519
§ 371 (c)(1),
(2) Date: Dec. 22, 2014

(87) PCT Pub. No.: WO2014/005230
PCT Pub. Date: Jan. 9, 2014

(65) Prior Publication Data

US 2015/0315880 A1 Nov. 5, 2015

Related U.S. Application Data

(60) Provisional application No. 61/667,999, filed on Jul. 4, 2012.

(51) Int. Cl.
*E21B 43/08* (2006.01)

(52) U.S. Cl.
CPC ..... *E21B 43/08* (2013.01); *E21B 43/082* (2013.01); *E21B 43/084* (2013.01); *E21B 43/086* (2013.01)

(58) Field of Classification Search
CPC ..... B01D 29/15; B01D 29/58; B01D 29/216; B01D 29/21; B01D 2201/188;
(Continued)

(56) References Cited

U.S. PATENT DOCUMENTS 1,256,830 A * 2/1918 Rodrigo ..... E21B 43/082 166/228
1,367,406 A * 2/1921 Marrs McLean ..... E21B 43/088 166/229

(Continued)

FOREIGN PATENT DOCUMENTS

BG 31730 3/1982
CA 2255071 6/1999

(Continued)

OTHER PUBLICATIONS

Singapore Examination Report dated May 25, 2016 regarding Singapore Application No. 11201500022U.

(Continued)

*Primary Examiner* — Kipp C Wallace
(74) *Attorney, Agent, or Firm* — Arent Fox LLP

(57) ABSTRACT

A wellbore screen for screening particulates in wellbore fluid comprising: a base pipe having an inner bore; and a screen section disposed in a section of the base pipe, the screen section comprising (i) an outer jacket having an inner facing surface and apertures extending through the outer jacket, (ii) an inner wall having an outer surface, an inner surface and a port extending through the inner wall from the inner surface to the outer surface, (iii) an annulus formed between the inner facing surface of the outer jacket and the outer surface of the inner wall, (iv) a filter medium for the apertures of the outer jacket; and (v) a filter disc disposed in the port of the inner wall, wherein wellbore fluid flows from outside the base pipe into the inner bore through the apertures, the filter medium, the annulus, and the filter disc.

15 Claims, 2 Drawing Sheets

(58) Field of Classification Search
CPC ..... E21B 43/08; E21B 43/082; E21B 43/088; E21B 43/084; E21B 43/086
See application file for complete search history.

(56) References Cited

U.S. PATENT DOCUMENTS

| | | | | |
|---|---|---|---|---|
| 1,473,644 | A | 11/1923 | Rodrigo, Sr. | |
| 1,488,753 | A | 4/1924 | Kelly | |
| 1,750,871 | A | 3/1930 | Wilson | |
| 2,308,568 | A * | 1/1943 | Rogers | A47L 13/04 15/229.12 |
| 2,391,609 | A | 12/1945 | Wright | |
| 2,401,035 | A | 5/1946 | Akeyson et al. | |
| 2,540,123 | A | 2/1951 | Kinley | |
| 2,798,768 | A * | 7/1957 | Benton | A01G 25/02 239/145 |
| 2,981,332 | A | 4/1961 | Miller Montgomery | |
| 3,177,945 | A | 4/1965 | Fether | |
| 3,213,950 | A | 10/1965 | Ghelfi et al. | |
| 3,273,641 | A | 9/1966 | Bourne | |
| 3,299,831 | A | 1/1967 | Watson et al. | |
| 3,322,199 | A | 5/1967 | Van Note, Jr. | |
| 4,706,751 | A | 11/1987 | Gondouin | |
| 5,310,000 | A | 5/1994 | Arterbury et al. | |
| 5,526,881 | A | 6/1996 | Martin et al. | |
| 5,551,513 | A | 9/1996 | Surles et al. | |
| 5,636,661 | A | 6/1997 | Moyes | |
| 5,664,628 | A | 9/1997 | Koehler | |
| 5,711,879 | A | 1/1998 | Carlson | |
| 5,816,742 | A | 6/1998 | Cordewener | |
| 5,881,809 | A * | 3/1999 | Gillespie | B01D 29/15 166/233 |
| 5,909,773 | A * | 6/1999 | Koehler | B01D 29/111 166/277 |
| 5,955,144 | A | 9/1999 | Sinclair et al. | |
| 6,006,829 | A | 12/1999 | Whitlock | |
| 6,012,522 | A | 1/2000 | Donnelly et al. | |
| 6,202,750 | B1 | 3/2001 | Ohanesian | |
| 6,514,408 | B1 | 2/2003 | Simone | |
| 6,561,732 | B1 | 5/2003 | Bloomfield et al. | |
| 6,645,769 | B2 | 11/2003 | Tayebi et al. | |
| 6,702,044 | B2 | 3/2004 | Reddy et al. | |
| 6,799,634 | B2 | 10/2004 | Hartog et al. | |
| 7,049,272 | B2 | 5/2006 | Sinclair et al. | |
| 7,258,166 | B2 * | 8/2007 | Russell | E21B 43/082 166/205 |
| 7,464,752 | B2 * | 12/2008 | Dale | E21B 43/04 166/227 |
| 7,475,725 | B2 | 1/2009 | Yeh | |
| 7,581,586 | B2 | 9/2009 | Russell | |
| 7,861,787 | B2 * | 1/2011 | Russell | E21B 43/082 166/169 |
| 7,891,420 | B2 | 2/2011 | Dale | |
| 8,464,793 | B2 * | 6/2013 | Scott | E21B 43/08 166/230 |
| 2001/0042620 | A1 | 11/2001 | Ohanesian | |
| 2002/0020527 | A1 | 2/2002 | Kilaas et al. | |
| 2004/0084186 | A1 | 5/2004 | Allison | |
| 2004/0231845 | A1 | 11/2004 | Cooke, Jr. | |
| 2005/0056425 | A1 | 3/2005 | Grigsby et al. | |
| 2006/0011345 | A1 | 1/2006 | Delaloye et al. | |
| 2007/0246212 | A1 | 10/2007 | Richards | |
| 2007/0256834 | A1 * | 11/2007 | Hopkins | E21B 43/082 166/278 |
| 2008/0006402 | A1 | 1/2008 | Russell | |
| 2008/0289815 | A1 * | 11/2008 | Moen | E21B 43/086 166/230 |
| 2010/0129682 | A1 * | 5/2010 | De Bondt | B21C 37/047 428/605 |
| 2011/0024111 | A1 | 2/2011 | Moen | |
| 2011/0180257 | A1 * | 7/2011 | Scott | E21B 43/088 166/276 |
| 2011/0257887 | A1 | 10/2011 | Cooper | |

FOREIGN PATENT DOCUMENTS

| | | | |
|---|---|---|---|
| CA | 2592970 | A1 | 1/2008 |
| CA | 2639384 | A1 | 6/2009 |
| DE | 1301300 | | 8/1969 |
| DE | 10031663 | | 8/2001 |
| EP | 1416118 | | 5/2004 |
| FR | 2906561 | B1 | 4/2008 |
| GB | 2169018 | A | 7/1986 |
| RU | 51664 | U1 | 2/2006 |
| RU | 101649 | U1 | 1/2011 |
| WO | 1997032648 | A1 | 9/1997 |
| WO | WO 2005/056977 | A1 | 6/2005 |
| WO | WO 2006/004426 | A1 | 1/2006 |
| WO | 2007130195 | A2 | 11/2007 |
| WO | WO 2011/153635 | A1 | 12/2011 |
| WO | WO 2011/153636 | A1 | 12/2011 |

OTHER PUBLICATIONS

Supplementary EP Search Report and Search Opinion dated Feb. 15, 2016, regarding EP13813013.

Introduction to Stars Screens, Absolute Engineering Inc., presented prior to Dec. 10. 2003.

Notification of Transmittal of International Search Report, International Search Report and Written Opinion in International Application No. PCT/CA2011/000698, dated Aug. 18, 2011.

International Search Report and and Written Opinion dated Sep. 2, 2011, in International Application No. PCT/CA2011/000699.

International Search Report and Written Opinion dated Sep. 13, 2013, regarding PCT/CA2013/050519.

Woiceshyn, G et al, "Mechanical Evaluation of a New Sand Control Screen for SAGD Applications" 2008 SPE International Thermal Operations and Heavy Oil Symposium Calgary Alberta Canada Oct. 20-23, 2008, Paper No. SPE/PS/CHOA 117486.

* cited by examiner

WELLBORE SCREEN

FIELD OF THE INVENTION

The present invention relates generally to a wellbore screen for screening particulates in wellbore fluids.

BACKGROUND

Various wellbore tubulars are known and serve various purposes. A wellbore screen is a tubular including a screen material forming or mounted in the tubular's wall. The wellbore screen can be used in wellbores such as those for water, steam injection and/or petroleum product production. The wellbore screen is employed to screen oversize particles from fluids passing therethrough and acts to stabilize the wellbore.

SUMMARY

In accordance with a broad aspect of the present invention, there is provided an apparatus for screening particulates in wellbore fluid comprising: a base pipe having an inner bore; and a screen section disposed in a section of the base pipe, the screen section comprising (i) an outer jacket having an inner facing surface and apertures extending through the outer jacket, (ii) an inner wall having an outer surface, an inner surface and a port extending through the inner wall from the inner surface to the outer surface, (iii) an annulus formed between the inner facing surface of the outer jacket and the outer surface of the inner wall, (iv) a filter medium for the apertures of the outer jacket; and (v) a filter disc disposed in the port of the inner wall, wherein wellbore fluid flows from outside the base pipe into the inner bore through the apertures, the filter medium, the annulus, and the filter disc.

In accordance with another broad aspect of the present invention, there is provided a method for screening fluid in a wellbore, the method comprising: installing a screen in the wellbore, the screen comprising a base pipe having an inner bore; and a screen section disposed in a section of the base pipe, the screen section comprising (i) an outer jacket having an inner facing surface and apertures extending through the outer jacket, (ii) an inner wall having an outer surface, an inner surface and a port extending through the inner wall from the inner surface to the outer surface, (iii) an annulus formed between the inner facing surface of the outer jacket and the outer surface of the inner wall, (iv) a filter medium for the apertures of the outer jacket; and (v) a filter disc disposed in the port of the inner wall; and permitting a fluid flow to be screened through the screen wherein wellbore fluid flows from outside the screen into the inner bore through the apertures, the filter medium, the annulus and the filter disc.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DETAILED DESCRIPTIONS

Figure 1:
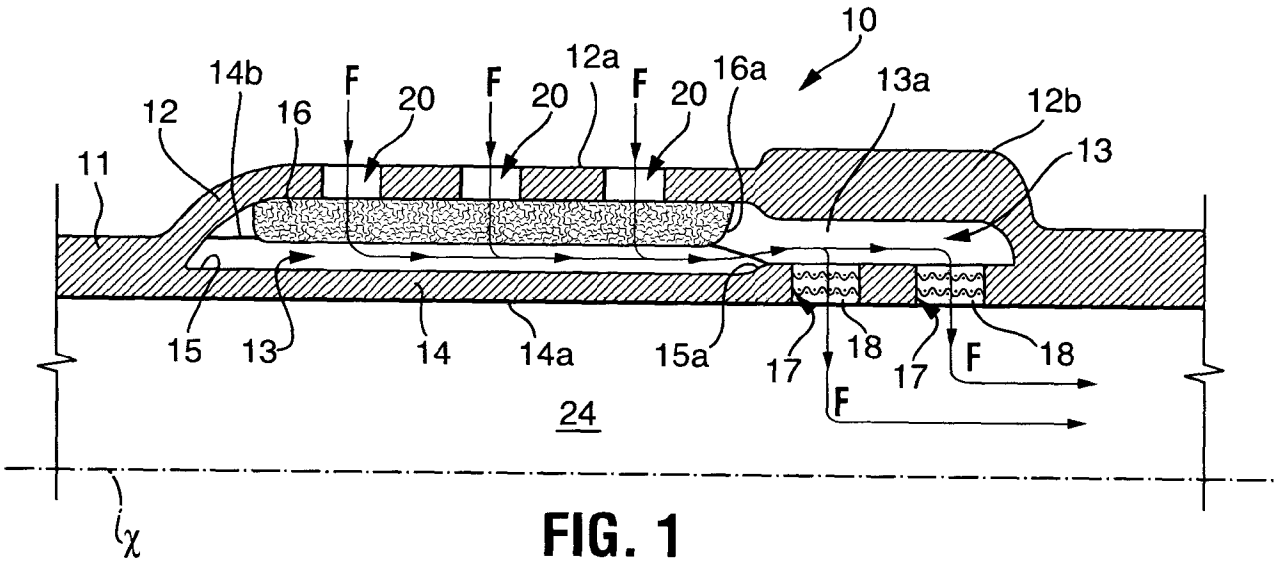
FIG. 1 is a cross-sectional view of a lengthwise portion of a wellbore screen.

The detailed description set forth below in connection with the appended drawing is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Referring to the Figures, a wellbore screen 10 is shown including a base pipe 11 and a screen section.

The screen section of the wellbore screen comprises an outer jacket 12 and an inner wall 14. In one embodiment, outer surface 12*a* of outer jacket 12 faces, and may be exposed to, the external environment about the wellbore screen. Inner surface 14*a* of inner wall 14 may be open to the inner diameter 24 of base pipe 11. A space, for example an annulus 13, is formed between the inner surface of outer jacket 12 and the outer surface 14*b* of inner wall 14.

Outer jacket 12 has apertures 20 that allow fluid to flow from the outer surface to the inner surface of outer jacket 12. A filter medium 16 is provided for filtering fluids passing through apertures 20. Filter medium 16 for apertures 20 may be installed in apertures 20, attached externally to outer jacket 12 or may be disposed adjacent the inner surface of outer jacket 12. In FIG. 1, filter medium 16 is positioned in annulus 13 adjacent the inner surface of outer jacket 12 and between the outer jacket and inner wall 14. In this position, filter medium is protected by outer jacket 12 from external forces such as abrasion, catching and tearing. Filter medium 16 is positioned in the path of fluid flow through apertures 20, such that any fluid flowing through apertures 20 must pass through filter medium 16.

Inner wall 14 includes one or more ports 17. Ports 17 allow fluid to flow from the outer surface to the inner surface 14*a* of inner wall 14. Outer jacket 12 extends at least over the portion of wall 14 that contains ports 17, such that the only way for fluid from outside the wellbore screen to reach ports 17 is through apertures 20 of jacket 12.

Ports 17 are the entry points for fluid to pass through wall 14 into inner bore 24. Thus, the number, size and position of ports 17 define the possible open flow area of the screen section.

Each port 17 is filled with a filter disc 18 for filtering fluids passing through ports 17. In FIGS. 1 and 3, the location of ports 17 is shown as being near one end of inner wall 14/outer jacket 12 and being axially offset from apertures 20 with a solid, non-apertured portion 12*b* of the outer jacket extending over ports 17. However, it can be appreciated that for some applications, such as that shown in FIG. 2, ports 17 may be positioned to roughly radially align with apertures 20.

Thus, for fluids passing into the wellbore screen, filter medium 16 provides a first stage filtration and filter discs 18 provide a second stage filtration.

Filter medium 16 can be made of materials such as including compressed fibers, randomly arranged fibers, mesh, porous material or combinations thereof, and may include specialized filtering materials such as a fusion bonded mesh laminate comprising multiple layers of woven steel meshes and/or compressed steel wool with randomly arranged fibers, such as MeshRite™ filter media (available from Absolute Completion Technologies Ltd., Calgary, Alberta, Canada) or the like, that is capable of operating in wellbore conditions. The filter medium must be permeable to selected fluids such as one or more of steam, stimulation fluids, oil and/or gas, while able to exclude oversized solid matter, such as sediments, sand or rock particles. Of course, certain solids may be permitted to pass, as they do not present a difficulty to the wellbore operation. The filter medium can be selected to exclude (i.e. filter out) oversize particles, which are those particles greater than a selected size, as desired.

In one embodiment, filter medium 16 includes MeshRite filter medium. The fibers in MeshRite filter medium are faceted, for example roughly triangular, in cross-section and are approximately 70 to 100 μm in thickness. This results in a plurality of angularly shaped pores ranging in size from 15 to 600 μm. In another embodiment, the fibers are laid up under compression onto the base pipe in a bat about 5 to 15 cm, for example 10 cm, wide with a weight of approximately 44 g/m. In yet another embodiment, filter medium 16 includes MeshRite filter medium having a filter bed with a thickness of approximately 2 to 8 mm, for example 5 mm, and a density of approximately 0.65 to 0.9 g/cc. This filter medium excludes particles in excess of about 80 μm and may exclude most particles down to 25 μm. Fines less than these sizes are allowed to pass, as this reduces media plugging.

In yet another embodiment, filter medium 16 includes fusion bonded mesh laminate, which may comprise a plurality, for example two to four layers of woven steel meshes of various sizes and weave patterns. It can be appreciated that other materials that function in wellbore conditions may be used for filter medium 16.

Filter discs 18 may be installed to reside in the wall thickness, such that if desired, they do not protrude beyond outer surface 14*b* or inner surface 14*a* of inner wall 14. In this way, they can be installed without risk of occluding the inner diameter or the annulus 13. By ensuring no more than flush mounting on the outer surface of wall 14, the outer diameter of the wellbore screen can be minimized, wherein the outer diameter of screen, for example at outer facing surface 12*a* of outer jacket need only be sized to accommodate the thickness of inner wall 14, annulus 13 with filter medium 16 therein and the thickness of outer jacket 12. This offers a much smaller outer diameter than a typical multilayer screen, which may allow a maximum inner diameter for any particular outer diameter.

Filter discs 18 can be made of materials such as including a layer of compressed randomly arranged fibers, woven media, fusion bonded mesh laminate, ceramic and/or sinter material that is capable of operating in wellbore conditions. The filter material must be permeable to selected fluids such as one or more of steam, stimulation fluids, oil and/or gas, while able to exclude oversized solid matter, such as sediments, sand or rock particles. Of course, certain solids may be permitted to pass, as they do not present a difficulty to the wellbore operation. The filter material can be selected to exclude particles greater than a selected size, as desired. The present filter discs 18 can employ one or more layers or types of filter materials. In one embodiment, filter discs 18 includes an inner woven screen, an outer woven screen and a fibrous material therebetween. In another embodiment, the filter disc may include a single layer of filter material to facilitate manufacture. Sintered material may be useful as a single layer filter material. In one embodiment, filter discs 18 are made of a plurality of layers (for example 10 to 15 layers) of woven steel, such as stainless steel, mesh. The layers may be fused together, such as by sintering.

In one embodiment, filter discs 18 are made of FacsRite™ filter discs (available from Absolute Completion Technologies Ltd., Calgary, Alberta, Canada). FacsRite discs are generally approximately 2 to 10 mm (for example 6.5 mm) thick and 12 to 40 mm (for example 25.4 mm) in diameter, but other dimensions may be used. FacsRite discs are usually made of many layers of 316L stainless steel sintered mesh, which is fusion bonded together. The meshes in FacsRite discs generally include fibers that are woven together like cloth, and fibers running in different directions in the "cloth" may be of different diameters. The "cloth" may also be of various weave patterns. Mesh fibers used in FacsRite filter discs are often substantially round in cross-section and their diameter ranges from 20 to over 1000 μm. It can be appreciated that other filter materials that operate in downhole conditions may be used for filter discs 18.

The strength, deformation, and filtration properties of the material used for filter discs 18 may be different from those of the material used for filter medium 16. For example, filter medium 16 and filter discs may differ in the materials employed, the exclusion rating (the size of materials excluded), the durability, etc.

Filter medium 16 may fill some or all of the volume of annulus 13. Filter medium 16 is positioned to affect flow through all apertures 20, but there may be spaces free of the filter medium remaining in annulus 13. In one embodiment, for example, filter medium 16 is not positioned directly over ports 17 such that the annulus contains an open space 13*a* between filter media 16 and ports 17, such as, for example, between the inner surface of outer jacket 12 and filter discs 18.

Filter media 16 may be laid directly on outer surface. In one embodiment, however, filter medium 16 is spaced at least to some degree from outer surface 14*b* of inner wall 14 such that open flow channel is formed. While separate spacers may be employed to space filter medium 16 out, in one embodiment, outer surface 14*b* has formed thereon one or more indentations forming one or more flow channels 15. Flow channels 15 may be formed by removing a portion of outer surface 14*b*, as by milling.

Flow channels 15 extend along the outer surface of inner wall 14 and provide a space between the underside of filter medium 16 and inner wall 14. Flow channels 15 extend from beneath filter medium toward ports 17. For example, the terminal ends of flow channels may extend beyond an end 16*a* of the filter medium. In one embodiment, flow channels 15 are indentations on the outer surface of inner wall 14 and are spaced apart, with raised portions therebetween, where the inner wall remains unremoved. Thus, each flow channel may be isolated, by spacing and the raised portions on which filter medium 16 rests, from other flow channels so that flow emanating from each flow channel may be predominantly from selected apertures 20 that are different apertures than the adjacent flow channels. As best seen in FIG. 3, flow channels 15, in one embodiment, may be substantially straight, extending substantially axially from beneath filter medium 16 toward ports 17 and each isolated by raised portions from the others. In one embodiment, flow channels 15 terminate at ports 17 or in an open space 13*a* of annulus 13 which is substantially free of medium 16 and adjacent ports 17. If flow channels 15 terminate away from ports 17, their terminal ends may be a shoulder 15*a*, that may be abrupt or gradual. With flow channels 15, filter medium 16 is supported on the normal diameter at the inner surface 14*b* of inner wall 14, but open spaces remain in flow channels 15.

In one embodiment, the screen section completely encircles the base pipe. In an alternative embodiment, the screen section covers only a portion of the circumference of the base pipe. In another embodiment, the wellbore screen has more than one screen section along the length of the base pipe. The illustrated wellbore screen is substantially symmetrical along its long axis x. Thus only a quarter section along axis x is shown.

Wellbore screen 10 may have ends 10*a*, 10*b* formed for connection into a wellbore string. For example, ends 10*a*, 10*b* may be formed for threaded connection to adjacent screens or other wellbore tubulars.

Figure 2:
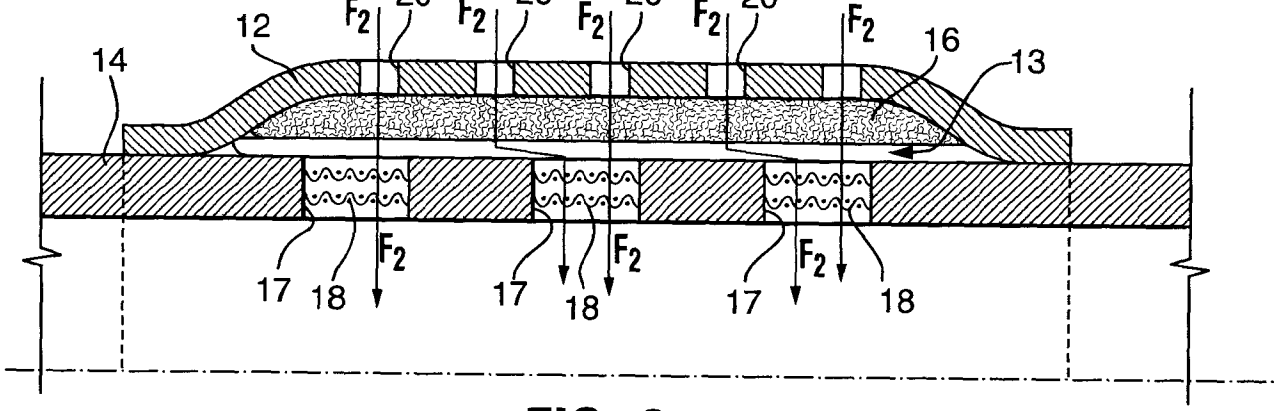
FIG. 2 is a cross-sectional view of a lengthwise portion of another wellbore bore screen.
Figure 3:
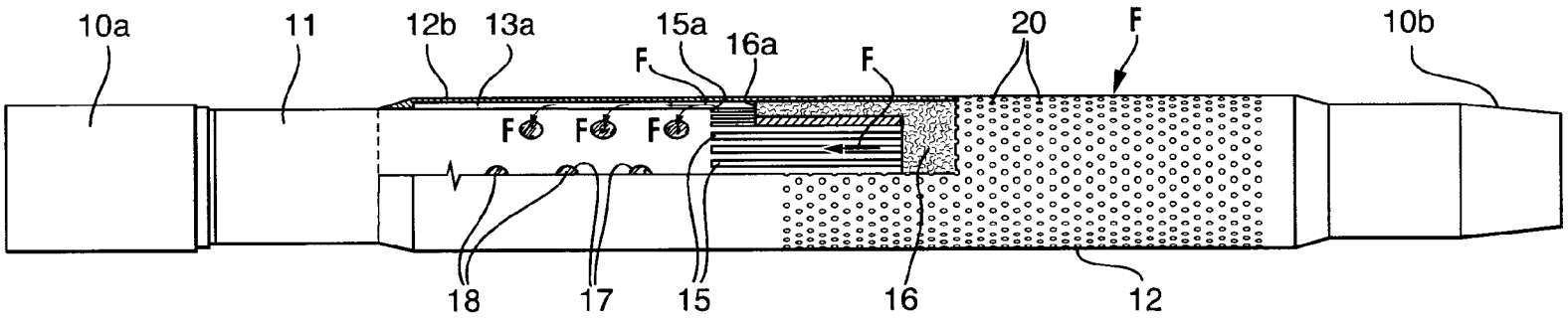
FIG. 3 is a side elevation of a wellbore screen, with portions of the outer jacket and filter medium cut away to facilitate illustration.

In operation, fluid may flow from outside the wellbore screen into the wellbore screen's inner bore 24 according to flow paths collectively designated F (FIG. 1) or F2 (FIG. 2).

More specifically, in normal conditions, fluid first flows through apertures 20 and passes through filter medium 16. The fluid may contain particulates and filter medium 16 may retain some of the particulates as the fluid passes therethrough. When the fluid exits filter medium 16, the fluid flows to ports 17 and through filter discs 18. The fluid then exits filter discs 18 and flows into inner bore 24 of the wellbore screen.

When the portion of outer jacket 12 that contains apertures 20 is somewhat aligned over the portion of inner wall 14 containing ports 17, as shown in FIG. 2, the flow F2 is substantially radial from the exterior of the screen to the inner bore 24 of the screen.

When the portion of outer jacket 12 that contains apertures 20 is axially offset from over the portion of inner wall 14 containing ports 17, as shown in FIG. 1, the flow F is initially substantially radial from outer surface 12*a* of the outer jacket to outer surface 14*b* of the inner wall. Then the flow is redirected to axial, substantially linear flow along outer surface 14*b*, for example, through channels 15. Thereafter, flow F is diverted by the solid portion 12*b* of the outer jacket to pass radially through filter discs 18 and into the inner bore of the screen. The diversion of flows from radial to axial to radial dissipates energy in the flows and reduces harmful, such as erosive, effects of the fluid flows and enhances screening since the force of the fluid to carry debris may be dissipated.

In one embodiment, filter medium 16 excludes a smaller particle size than filter discs 18, such that particles that pass through filter medium 16, under normal operation, can also pass through filter discs 18. Thus, for example, in one embodiment, if filter medium 16 excludes particles in excess of about 80 μm and discs 18 only exclude particles greater 80 μm and perhaps even a lower rating such as greater than 100 μm. Thus, fines passing through medium 16, under normal operation, are not retained on discs 18, as this reduces particulate retention in annulus 13 and therefore reduces the possibility of screen plugging under normal operations.

In the event that filter medium 16 is compromised, for example filter medium 16 fails by degradation, erosion, installation damage, etc., much or all of the particulates in the fluid will flow without filtration through perforations 20 at the region of the compromised medium and into annulus 13. As the fluid continues to flow through annulus 13 to filter discs 18, particulates that are too large to pass through filter discs 18 will accumulate in annulus 13 at discs 18, for example, in one or more flow channel 15 and/or in open space 13*a* adjacent ports 17. When the space 13*a* over a filter disc is substantially filled with particulates, little fluid will be able to flow through that filter disc. Therefore, flow through that disc into inner bore 24 becomes automatically shut off without the operator's intervention, mechanically or otherwise. Depending on the nature of the particulate accumulation in space 13*a*, the flow through that screen section may be partially or fully shut off. If particulate accumulation backs up to the flow channel from which compromised flow results before all discs 18 are blocked, the screen may continue to flow, but flow through the one or more flow channels that receive flow from the region of compromised filter medium is shut off.

For example, if the screen includes a first flow channel and a second flow channel and each of the first flow channel and the second flow channel is free of filter medium, extends between the filter medium and the outer surface and includes a terminal end extending out from an edge of the filter medium toward the port and wherein the first flow channel is isolated by the filter medium from the second flow channel except at the terminal end, during normal operations, a fluid flow to be screened, may include a first portion flowing along the first fluid channel and a second portion of the fluid flow flowing along the second fluid channel. If particulate begins to accumulate in the annulus from the first portion of the fluid flow, the particulate may progressively accumulate and resist flow therepast until flow through the first channel is substantially stopped. This may occur while fluid flow through the second fluid channel continues.

On the other hand, should there be a more significant failure of filter medium 16, all discs 18 may be blocked to completely close off flow through the screen section. This may occur even where there are a plurality of flow channels, as flow ultimately requires passage through discs 18 into inner bore. If particulate begins to accumulate in the annulus about the ports, the particulate may progressively accumulate and resist flow therepast until flow through the ports is substantially stopped.

Therefore, the wellbore screen described herein provides a redundant screening and self-shutoff mechanism that may help prevent fluid with unfiltered fluids and problematic particulates from entering inner bore 24.

Since the size, number and position of ports 17 define the possible open flow area of the screen section, the number, size and position of ports 17 can be selected to define the sensitivity of the shut off mechanism (i.e. the speed at which the screen will shut off in the event that filter medium 16 is compromised. For example, should a more sensitive screen be desired that shuts down more readily, a screen with fewer ports 17 may be employed.

It will be appreciated that the wellbore screen can be constructed in various ways. For example, in FIG. 1, outer jacket 12 is shown to be integrated with base pipe 11; however, it can be appreciated that outer jacket 12 may be a separate part that is mounted onto base pipe 11, as shown in FIG. 3 where the jacket is crimped onto the base pipe to create a seal where they come together. Also in FIG. 1, inner wall 14 is shown integrated with base pipe; however, it can be appreciated that the inner wall may be a separate part that is connected onto base pipe 11. It may facilitate construction to form inner wall 14 as an integral portion of base pipe 11. This may increase the durability and operation of the screen, for example, allowing it to have excellent response and unchanged permeability even when subjected to torque and/or forces in tension and compression. It may facilitate construction to form outer jacket 12 as a part separate from base pipe 11 but installed thereover by an end ring, crimping, welding, etc.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. An apparatus for screening particulates in wellbore fluid comprising:

a base pipe having an inner bore; and a screen section disposed in a section of the base pipe, the screen section comprising (i) an outer jacket having an inner facing surface and apertures extending through the outer jacket, (ii) an inner wall having an outer surface, an inner surface and a port extending through the inner wall from the inner surface to the outer surface, (iii) an annulus formed between the inner facing surface of the outer jacket and the outer surface of the inner wall, (iv) a filter medium for the apertures of the outer jacket; and (v) a filter disc disposed in the port of the inner wall, the filter disc being axially offset from the apertures and positioned adjacent an end of the annulus with a non-apertured portion of the outer jacket extending over the filter disc, wherein wellbore fluid flows from outside the base pipe into the inner bore through the apertures, the filter medium, the annulus, and the filter disc, wherein the filter medium screens finer debris than the filter disc, and wherein the filter disc is configured to automatically shut off a flow of the wellbore fluid into the inner bore by at least a portion of the filter disc when the filter medium is compromised.

2. The apparatus of claim 1 wherein the filter medium is positioned in the annulus adjacent the inner facing surface of the outer jacket.

3. The apparatus of claim 1 wherein the annulus is devoid of filter medium in an area adjacent the port.

4. The apparatus of claim 1 wherein filter medium includes a compressed steel wool.

5. The apparatus of claim 4 wherein the compressed steel wool includes randomly arranged fibers, the fibers being substantially triangular in cross sectional shape and being 70 to 100 μm in thickness.

6. The apparatus of claim 1 wherein the filter disc is installed in the inner wall to be at most flush with the outer surface and the inner surface.

7. The apparatus of claim 1 wherein the filter disc includes fusion bonded mesh laminate.

8. The apparatus of claim 7 wherein the fusion bonded mesh laminate includes 10 to 15 layers of woven steel mesh sintered together.

9. The apparatus of claim 1 wherein the filter medium is spaced from the outer surface at least in some areas.

10. The apparatus of claim 1 wherein the outer surface includes one or more flow channels free of the filter medium and wherein the one or more flow channels extend out from beneath the filter medium toward the port.

11. The apparatus of claim 10 wherein there are a plurality of flow channels and each of the plurality of flow channels is an indentation on the outer surface and is spaced apart with filter medium between each of the plurality of flow channels.

12. A method for screening fluid in a wellbore, the method comprising:

installing a screen in the wellbore, the screen comprising a base pipe having an inner bore; and a screen section disposed in a section of the base pipe, the screen section comprising (i) an outer jacket having an inner facing surface and apertures extending through the outer jacket, (ii) an inner wall having an outer surface, an inner surface and a port extending through the inner wall from the inner surface to the outer surface, (iii) an annulus formed between the inner facing surface of the outer jacket and the outer surface of the inner wall, (iv) a filter medium for the apertures of the outer jacket; and (v) a filter disc disposed in the port of the inner wall, the filter disc being axially offset from the apertures and positioned adjacent an end of the annulus with a non-apertured portion of the outer jacket extending over the filter disc; and permitting a fluid flow to be screened through the screen, wherein wellbore fluid flows from outside the screen into the inner bore through the apertures, the filter medium, axially along the outer surface through the annulus and the filter disc, wherein the filter medium screens finer debris than the filter disc, and wherein the filter disc is configured to automatically shut off a flow of the wellbore fluid into the inner bore by at least a portion of the filter disc when the filter medium is compromised.

13. The method of claim 12 further comprising accumulating particulate from the fluid flow in the annulus at the filter disc until flow through the filter disc is stopped.

14. The method of claim 12 wherein the screen section includes a first flow channel and a second flow channel and each of the first flow channel and the second flow channel is free of filter medium, extends between the filter medium and the outer surface and includes a terminal end extending out from an edge of the filter medium toward the port and wherein the first flow channel is isolated by the filter medium from the second flow channel except at the terminal end; and wherein during permitting a fluid flow to be screened, a first portion of the fluid flow flows along the first fluid channel and a second portion of the fluid flow flows along the second fluid channel.

15. The method of claim 14 further comprising accumulating particulate from the first portion of the fluid flow in the first channel until flow through the first channel is stopped, while fluid flow through the second fluid channel continues.

* * * * *